US005564825A

United States Patent [19]

Burt

[11] Patent Number: 5,564,825

[45] Date of Patent: Oct. 15, 1996

[54] INTEGRAL INLET VALVE AND MIXER TO PROMOTE MIXING OF FLUIDS IN A TANK

[75] Inventor: R. Douglas Burt, St. George, Canada

[73] Assignee: Shrader Canada Limited, Oakville, Canada

[21] Appl. No.: 42,437

[22] Filed: Apr. 5, 1993

Related U.S. Application Data

[63] Continuation-in-part of Ser. No. 984,614, Dec. 2, 1992, abandoned.

[51] Int. Cl.[6] ..... B01F 5/04

[52] U.S. Cl. ..... 366/175.2; 366/101; 366/136; 366/182.4; 137/533.29; 141/286; 239/142; 239/504; 239/506; 239/512; 239/524; 251/144; 251/147; 251/154

[58] Field of Search ..... 366/101, 106, 366/136, 137, 154, 159, 167, 171, 174, 182, 336–338, 340, 174.1, 175.2, 182.4; 141/286, 312, 368; 239/143, 571, 504, 506, 507, 512, 514, 518, 520, 524, 142; 222/195; 137/533.29; 251/144, 147, 154

[56] References Cited

U.S. PATENT DOCUMENTS

| | | | |
|---|---|---|---|
| 923,571 | 6/1909 | Paterson | 366/137 |
| 1,026,578 | 5/1912 | Hammond | 366/137 |
| 1,087,242 | 2/1914 | Kelly | 239/520 X |
| 1,160,848 | 11/1915 | Conklin | 366/137 X |
| 1,692,795 | 11/1928 | Clifford | 137/533.29 X |
| 2,011,812 | 8/1935 | Hatcher et al. | 137/533.29 X |
| 2,259,011 | 10/1941 | Taylor | 239/524 X |
| 2,365,293 | 12/1944 | Robinson | 366/136 X |
| 2,372,629 | 3/1945 | Nelson | 137/533.29 X |
| 2,391,858 | 1/1946 | Auer | 366/136 |
| 2,723,879 | 11/1955 | Martin | 251/154 X |
| 3,101,176 | 8/1963 | Goss | 239/523 X |
| 3,271,304 | 9/1966 | Valdespino et al. | 366/101 X |
| 3,397,842 | 8/1968 | Frandsen | 239/524 X |
| 3,756,515 | 9/1973 | Arnold | 239/524 |
| 3,799,508 | 3/1974 | Arnold et al. | 366/174 |
| 3,811,620 | 5/1974 | Gebhardt | 239/504 X |
| 3,893,659 | 7/1975 | Krish | 366/137 X |
| 4,739,964 | 4/1988 | Hutt | 251/154 X |
| 4,893,937 | 1/1990 | Braun | 366/136 |
| 5,017,053 | 5/1991 | Sisk | 366/101 X |

*Primary Examiner*—Charles E. Cooley
*Attorney, Agent, or Firm*—Keck, Mahin & Cate

[57] ABSTRACT

A mixer for mixing and blending fluids within a vessel includes a passageway through which fluid is dispensed within the vessel and a flow diverter spaced from the passageway. Fluid impinges on the flow diverter and is directed toward the walls of the vessel. The diverter includes holes that produce jets of fluid generally parallel to the walls of the vessel to induce shear and turbulence within the fluid in the vessel.

30 Claims, 2 Drawing Sheets

INTEGRAL INLET VALVE AND MIXER TO PROMOTE MIXING OF FLUIDS IN A TANK

This application is a continuation-in-part of application Ser. No. 07/984,614 filed Dec. 2, 1992, now aboandoned.

The present invention relates to a mixer for use in mixing fluids within a tank.

BACKGROUND OF THE INVENTION

It is frequently necessary to mix a number of fluids. In certain applications, these fluids have to be mixed thoroughly to provide a uniform homogenous composition and this is usually done in a mixing or blending tank. The individual components are introduced into the tank, subsequently mixed, and then discharged to another container. The mixing is usually accomplished by mechanical agitators disposed within the tank and driven through electric motors, gear drives and the like. These agitators perform an adequate mixing but tend to be relatively slow and complex mechanical devices. Moreover, they are normally designed to be used with a full batch of components within a tank and where it is desirable to mix smaller quantities, the agitators are not as efficient.

It is therefore an object of the present invention to provide a mixer which obviates or mitigates the above disadvantages.

SUMMARY OF THE INVENTION

In general terms, the present invention provides a mixer in which fluid is supplied through a passageway in the body of the mixer. The mixer is located within a tank and a flow diverter is disposed in spaced relationship over the end of the passageway. Fluid flowing through the passageway impinges on the flow diverter and is directed laterally outward within the tank. In this manner, a highly turbulent flow is generated within the tank, causing a thorough mixing of the components in the tank, even where they are introduced serially into the tank.

It is preferred that the flow diverter includes a number of apertures that produce jets extending along the axis of the tank which increase turbulence in the mixing of the fluid within the tank.

It is also preferred that the flow diverter is movable relative to the body so it may move into sealing engagement with the body and prevent reverse flow of the fluid from the tank.

BRIEF DESCRIPTION OF THE DRAWINGS

An embodiment of the invention will now be described by way of example only with reference to the accompanying drawings, in which.

DESCRIPTION OF PREFERRED EMBODIMENTS

Figure 1:
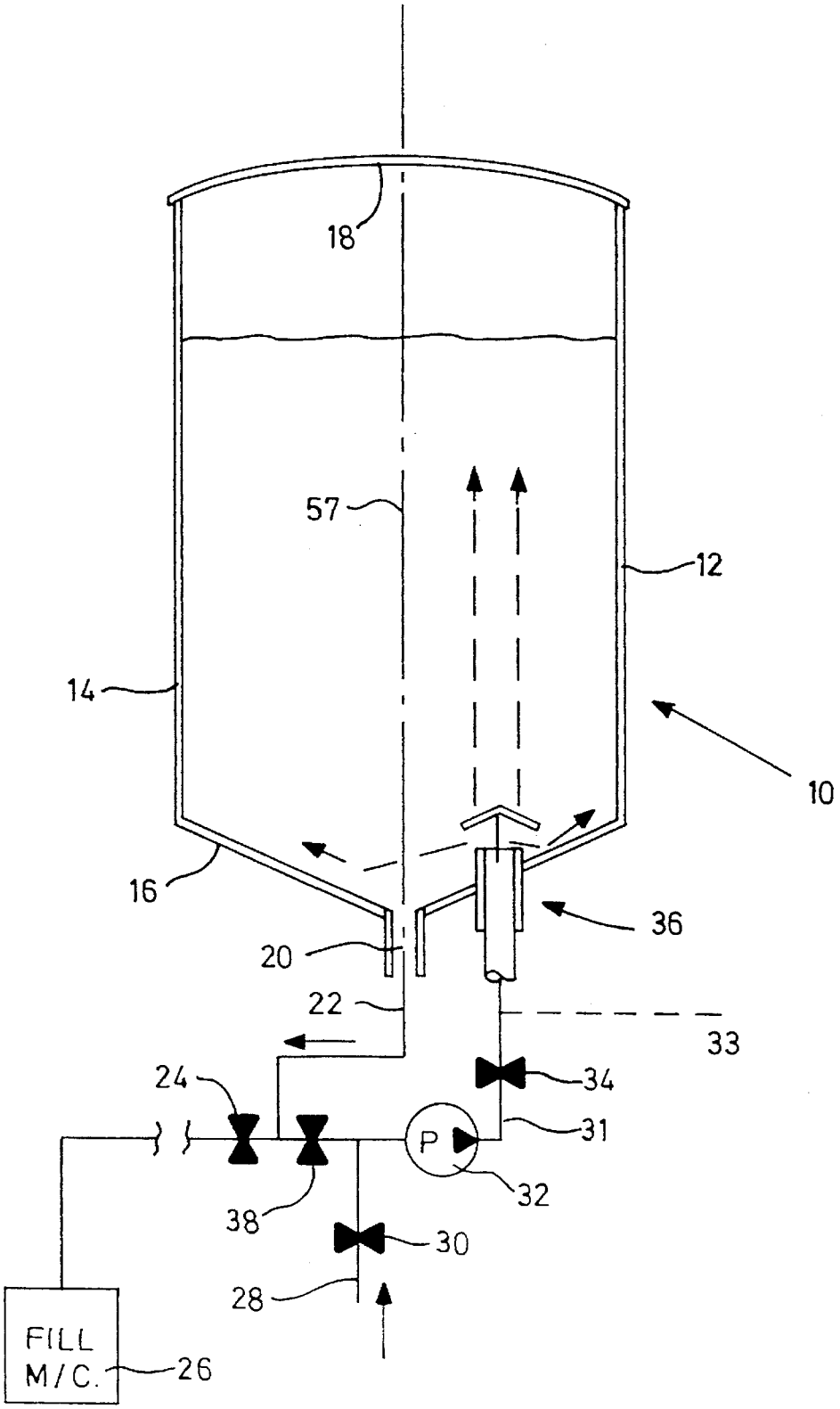
FIG. 1 is a schematic representation of a tank with a mixer installed.

Referring therefore to FIG. 1, a mixing system 10 includes a tank 12 having a side wall 14, end wall 16 and a lid 18. The end wall 16 is conical and has an outlet 20 at the lowest portion of the wall. The outlet 20 is connected through an outlet duct 22 and valve 24 to a filling machine 26.

Fluid from an external source is supplied to the tank 12 through a supply duct 28 connected through valve 30 to a pump 32. The outlet from the pump 32 is directed through a valve 34 and an inlet duct 31 to a mixer 36 located in the end wall 16 and offset from the outlet 20. It will also be noted that the outlet duct 22 may be connected to the inlet of the pump 32 through a valve 38 if so desired.

Figure 2:
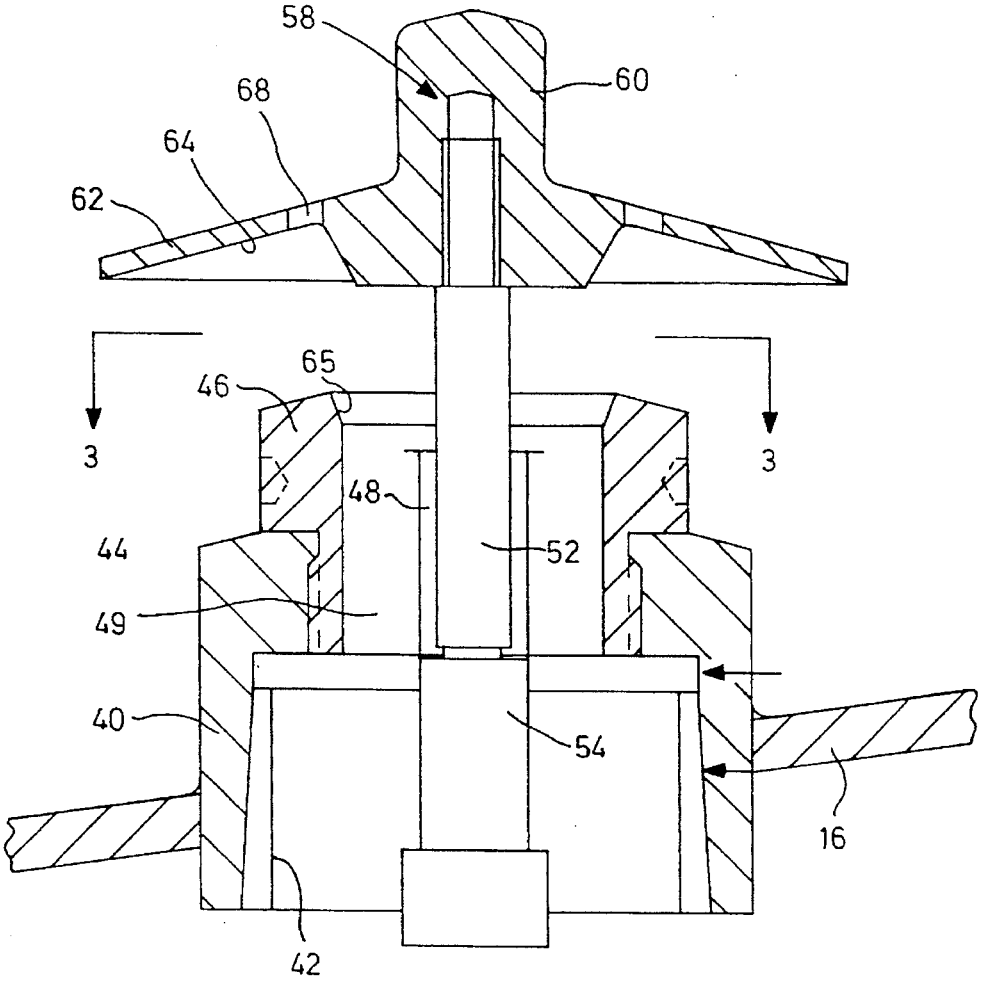
FIG. 2 is a section through a mixer shown in FIG. 1 but on an enlarged scale.
Figure 3:
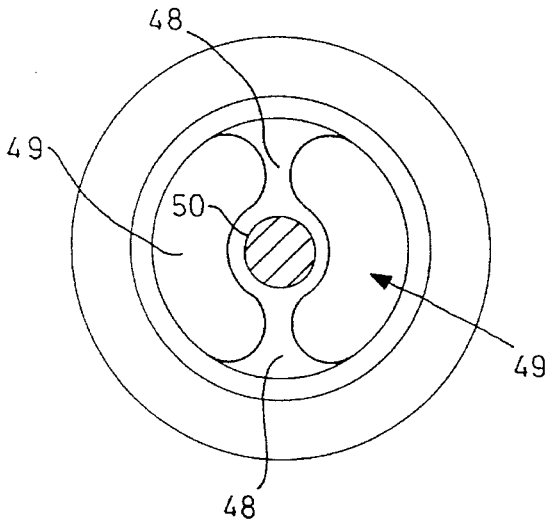
FIG. 3 is a section on the line 3—3 of FIG. 2.

Referring now to FIG. 2, the mixer 36 includes a cylindrical body 40 welded to the end wall 16. A bore 42 extends through the body 40. The body 40 has a threaded counterbore 44 to receive the supply duct 28. An annular supporting collar 46 is mounted in the bore 42 and provides a passage 49 to allow fluid to flow from the duct 28 into the tank 12. The collar 46 has a diametric web 48 extending across the passage 49 and carrying a boss 50 through which a pin 52 may slide. The pin 52 includes a shoulder 54 which abuts the lower edge of the boss 50 flange 48 and limits axial movement of the pin 52 relative to the collar 46.

A flow diverter 58 is supported on the opposite end of the pin 52 for movement with the pin 52. The flow diverter has a central boss 60 with a conical flange 62 extending from the boss 60. The under surface 64 of flange 62 is directed toward the collar 46 and downwardly inclined to the tank wall 16 to provide a concave,frustoconical impingement surface. A frustoconical seat 66 depends from the centre of the surface 64 and is complementary to a conical sealing surface 65 formed around the passageway 49 at the margin of the collar 46.

A plurality of apertures 68 is formed in the flange 62 around the periphery of the seat 66 and each extends through the flange 62 from the inclined surface 64. The axis of the apertures 68 is generally parallel to the axis of the pin 52 and directed along the axis of the tank 12. The apertures 68 are uniformly distributed about seat 66 and are dimensioned to provide a relatively high velocity jet. In a typical application with a 2 inch supply pipe, it was found that four apertures each of 5/16" diameter provided the appropriate jet size. It will also be noted that the apertures 68 are located generally in line with the fluid flowing through passage 49 so that the fluid impinges directly onto the apertures.

In operation, each of the fluids to be mixed is supplied to the mixer 36 from the pump 32 through the inlet duct 31. The fluid flows through the passages 49 in the collar 46 and is directed onto the surface 64. The majority of the flow is diverted radially outwardly beyond the mixer 36 as indictated by arrows F in FIGS. 1 and 2 to induce circulation of the fluid within the tank 12.

A small portion of the fluid passes through the aperture 68 and generates relatively high velocity jets of fluid extending parallel to the axis 57 of the tank as indicated by arrows J. The fluid in the tank is thus subjected to extremely turbulent shearing action from the fluid being introduced and thus promotes thorough mixing.

The shoulder 54 limits axial movement of the flow diverter 58 relative to the body 40 and the spacing between the flow diverter and the upper edge of the collar 46 defines the velocity at which fluid is directed into the tank.

Once the required amount of a fluid has been introduced into the tank, the flow terminates and the flow diverter 58 will move towards the body 40 and cause the seat 66 to engage with the inclined surface 65. The aperture 68 is located laterally outwardly of the seat 66 and so the flow diverter inhibits flow of the fluid through the passages 49 and out of the tank.

Different fluids may be introduced sequentially from different external sources and will be mixed with the fluid already in the tank as it is introduced. Once mixing is complete, the mixed fluid may be withdrawn through the outlet duct 22 to the filling machine 26. However, if further mixing of the fluids is required, the outlet duct 22 is connected to the inlet of the pump 32 by opening the valve 38 and the fluid within the tank can circulate through the pump, inducing further mixing. This mixing will be efficient even with only a small volume of fluid within the tank, enabling partial batches of fluid to be thoroughly mixed. Alternatively, as shown in chain dot line in FIG. 1, an air line 33 may be connected to the inlet duct 31 between the valve 34 and mixer 36 so that air under pressure is introduced into the body of fluid. The mixer 36 is effective to direct the air within the body of fluid to generate highly turbulent conditions within the tank 12 and thereby promote further mixing of the fluids. The air is vented from the vessel in any conventional manner.

The disposition of the mixer 36 in the tank 12 is chosen to promote turbulence and shear action in the lower section of the tank 12 as well as at the top. As indicated in FIG. 1, the flow diverted by the surface 64 induces rotation of the fluid along the axis of the tank with the fluid jets produced by the apertures 68 inducing a contrarotation. The inclination of the surface 64 is selected to direct the flow toward the intersection of the side and end walls so that a thorough mixing is obtained. In a preferred embodiment, the inclination of the surface 64 to the horizontal is approximately 15°.

We claim:

1. A mixer for mixing fluids in a tank, said mixer comprising a body having a supply passage extending through said body to convey fluids and to discharge fluid through a discharge port located at one end of said supply passage, said mixer including a flow diverter spaced from said discharge port to be impinged by a fluid flowing through said port, said flow diverter including an impingement surface directed toward said supply passage and extending laterally beyond said supply passage to direct fluid radially relative to said supply passage, said flow diverter being slidably mounted in said body to permit relative movement between said impingement surface and said discharge port and having an abutment to limit movement of said flow diverter away from said, body, said flow diverter having at least one aperture extending from said impingement surface through said flow diverter to provide a jet of said fluid flowing through said discharge port generally parallel to the direction of fluid flow in said supply passage.

2. A mixer according to claim 1 wherein said impingement surface is movable into engagement with said body to inhibit flow of fluid through said supply passage.

3. A mixer according to claim 2 wherein a seat is provided on said impingement surface and is engageable with a complementary seat provided on said discharge port.

4. A mixer according to claim 3 wherein said seats are each frustoconical.

5. A mixer according to claim 4 wherein said flow diverter is slidable relative to said body and an abutment limits relative movement between said diverter and said body.

6. A mixer according to claim 1 wherein said flow diverter is slidably supported by a pin extending along said supply passage and said abutment is provided on said pin to limit movement of said flow diverter relative to said supply passage.

7. A mixer according to claim 6 wherein said pin is secured to said flow diverter for movement therewith and is slidable relative to said body.

8. A mixer according to claim 1 wherein said flow diverter is movable relative to said body and said impingement surface is movable into engagement with said body, said at least one aperture being located laterally outward of said passage.

9. A mixer according to claim 8 wherein a seat is provided on said impingement surface to engage a complementary seat on said body and said at least one aperture is located laterally outwardly of said complementary seat.

10. A system according to claim 9 wherein said seat on said impingement surface is frustoconical and said at least one aperture is located adjacent the periphery of said seat on said impingement surface whereby fluid flowing across said seat on said impingement surface is directed to said at least one aperture.

11. A mixer according to claim 10 wherein a plurality of apertures is provided at circumferentially spaced locations about the periphery of said seat on said impingement surface.

12. A mixer according to claim 1 wherein said impingement surface is concave.

13. A mixer for mixing fluids in a tank, said mixer comprising a body having a supply passage extending through said body to convey fluids and to discharge fluid through a discharge port located at one end of said supply passage, said mixer including a flow diverter spaced from said discharge port to be impinged by a fluid flowing through said port, said flow diverter including an impingement surface directed toward said supply passage and extending laterally beyond said supply passage to direct fluid radially relative to said supply passage, said flow diverter being movably mounted in said body to permit relative movement between said impingement surface and said discharge port, said flow diverter having at least one aperture extending from said impingement surface through said flow diverter to provide a jet of said fluid flowing through said discharge port generally parallel to the direction of fluid flow in said supply passage, wherein said impingement surface is concave and wherein a frustoconical seat projects from said impingement surface at the center of said flow diverter.

14. A mixer according to claim 13 wherein said at least one aperture is located adjacent the periphery of said seat.

15. A mixer according to claim 14 wherein said impingement surface is frustoconical.

16. A mixer according to claim 14 wherein said flow diverter is movable relative to said body and said seat is engageable with a complementary seat on said body to inhibit flow of fluid through said passage.

17. A mixing system for mixing fluids comprising a tank having an external wall with a supply duct to supply fluid to said tank, said tank having a longitudinal axis a mixer located in said tank and having a passage communicating with said supply duct and terminating in a discharge port to discharge fluid into said tank, and a fluid outlet to remove fluid from said tank, said mixer including a flow diverter mounted for movement relative to said discharge port to be impinged by fluid flowing through said port, said flow diverter including an impingement surface directed toward said passage, said impingement surface extending laterally beyond said passage to direct fluid generally radially from said discharge port and being movable between a first position in which said impingement surface is spaced from said discharge port to a second position in which said impingement surface engages said discharge port, at least one aperture extending from said impingement surface through said flow diverter to generate a jet of fluid along said tank in a direction generally parallel to said longitudinal axis of said tank.

18. A mixing system according to claim 17 wherein said mixer is located adjacent a portion of said wall and said impingement surface is concave and is directed toward said wall.

19. A system according to claim 18 wherein said portion of said wall is concave toward the interior of said tank and said impingement surface directs fluid toward said concave wall.

20. A system according to claim 19 wherein said portion of said wall defines a generally horizontal end wall of said tank and said outlet is located on said portion and below said mixer.

21. A system according to claim 20 wherein said mixer is offset from said outlet.

22. A system according to claim 21 wherein said external wall includes a generally cylindrical portion located about the periphery of said concave portion and said impingement surface directs fluid to the intersection of said portions of said wall.

23. A system according to claim 22 wherein said jet of fluid is directed generally parallel to said cylindrical portion of said wall.

24. A system according to claim 23 wherein said at least one aperture is located laterally outward of said passage.

25. A system according to claim 24 wherein a seat is provided on said impingement surface to engage a complementary seat on said body and said at least one aperture is located laterally outward of said seat on said impingement surface.

26. A system according to claim 25 wherein said seat on said impingement surface is frustoconical and said at least one aperture is located adjacent the periphery of said seat on said impingement surface whereby fluid flowing across said seat on said impingement surface is directed to said at least one aperture.

27. A system according to claim 26 wherein a plurality of apertures is provided at circumferentially spaced locations about the periphery of said seat on said impingement surface.

28. A system according to claim 17 wherein a pump is connected to said supply duct and said outlet is selectively connectable to said pump to permit recirculation of fluid from said outlet to said supply duct.

29. A system according to claim 17 wherein a supply of pressurized air is connected selectively to said supply duct to direct air into said tank through said flow diverter and thereby promote mixing of fluids in said tank.

30. A system according to claim 29 wherein a pump is connected to said supply duct and said outlet is selectively connectable to said pump to permit recirculation of fluid from said outlet to said supply duct.

* * * * *